US005809822A

United States Patent [19]

Butty

[11] Patent Number: 5,809,822

[45] Date of Patent: Sep. 22, 1998

[54] METHOD OF PRODUCING A METALLIC HOLLOW BODY WITH A BREAKING LINE

[76] Inventor: Jean-François Butty, Résidence Panorama A, CH-1605 Chexbres, Switzerland

[21] Appl. No.: 716,393

[22] PCT Filed: Jan. 25, 1995

[86] PCT No.: PCT/CH95/00016

§ 371 Date: Sep. 25, 1996

§ 102(e) Date: Sep. 25, 1996

[87] PCT Pub. No.: WO96/22845

PCT Pub. Date: Aug. 1, 1996

[51] Int. Cl.[6] ..... B21C 1/24

[52] U.S. Cl. ..... 72/275; 72/283; 83/885

[58] Field of Search ..... 72/275, 283, 274, 72/187, 204; 83/876, 884, 885

[56] References Cited

U.S. PATENT DOCUMENTS

| | | | |
|---|---|---|---|
| 3,487,673 | 1/1970 | House | 72/283 |
| 3,494,164 | 2/1970 | Rehm | 72/187 |
| 3,744,290 | 7/1973 | Sirois | 72/283 |
| 4,057,992 | 11/1977 | Willimzik | 72/283 |
| 4,313,328 | 2/1982 | Janssen | 72/283 |
| 4,377,165 | 3/1983 | Luther et al. . | |
| 4,403,491 | 9/1983 | Wassen | 72/283 |
| 4,449,973 | 5/1984 | Luther . | |
| 4,776,846 | 10/1988 | Wells . | |

FOREIGN PATENT DOCUMENTS

| | | | |
|---|---|---|---|
| 0 245 837 | 11/1987 | European Pat. Off. . | |
| 0 435 157 | 7/1991 | European Pat. Off. . | |
| 528.271 | 11/1972 | Switzerland . | |
| 768526 | 10/1980 | U.S.S.R. | 72/204 |
| 1470388 | 4/1989 | U.S.S.R. | 72/204 |
| WO 82/03558 | 10/1982 | WIPO . | |

*Primary Examiner*—Daniel C. Crane

*Attorney, Agent, or Firm*—Clifford W. Browning; Woodard, Emhardt, Naughton, Moriarty & McNett

[57] ABSTRACT

Disclosed is a method of producing a hollow metallic body having a cylindrical shell provided on its outer surface with at least one predetermined breaking line. The shell is formed by a drawing process and the predetermined breaking line is produced continuously by rolling-in before, during or after said drawing process.

3 Claims, 5 Drawing Sheets

METHOD OF PRODUCING A METALLIC HOLLOW BODY WITH A BREAKING LINE

This application is a 371 of PCT/CH95/00016, filed Jan. 25, 1995.

The invention relates to a method for producing a metallic hollow body having a cylindrical shell which is provided on its outer surface with at least one predetermined breaking line.

Cylindrical hollow bodies of this type can in particular be hollow bodies with a thin wall which are, for example, adapted for use as metallic packing bodies as also as so-called splittable cannula which are used to introduce medical devices, such as catheters, endoscopes, etc., into the human or animal body. The provided predetermined breaking lines make it possible to remove the packing of the cannula without damaging the items contained therein, for example, sensible foodstuffs, precision apparatus, articles of art, jewelry, biologic preparations, such as virus and bacteries, electronic circuits, in particular memory units to be protected from light and electromagnetic radiation, or the mentioned medical instruments. In the case of a splittable cannula, the predetermined breaking line has to render possible the removal of the cannula after the introduction of the instruments concerned without wounding the human or animal body. With such a hollow body, it is in particular possible to provide a container for gas-, vacuum- and radiation-safe preservation, the opening of which must be effected without touching the item to be protected, thus in particular in a sterile way.

SUMMARY OF THE INVENTION

It is an object of the invention to produce said predetermined breaking line on the outer wall of a metallic hollow body, in particular of a hollow body with thin wall, in a continuous manufacturing process, whereby in particular a breaking line should be achieved and the desired outer and inner shape of the hollow body should be maintained.

If the predetermined breaking lines of such a hollow body are made, for example, by milling or stamping, either sharp edges or burrs occur which are an additional source of wounding and infection, in particular in medical use, or a deformation of the wall of the hollow body occurs which causes a modification of the shape of its cross-section in the region of the predetermined breaking line. In a stamping process, furthermore a deformation of the cross section of the hollow body as a whole is produced which can lead to high frictional forces, for example in the case of a splittable cannula having a rotational symmetry, when a medical instrument with narrow dimensional tolerances with respect to the inner diameter of the cannula is being introduced, and thus the medical action is hindered. On the other hand, such narrow dimensional tolerances are required to achieve tightness between the cannula and the medical instrument.

The method according to the invention is characterized in that the shell is formed by a drawing process and the predetermined breaking line is produced continuously by non-chip forming on the outer surface of said shell before, after or during this drawing process.

The predetermined breaking line can in particular be produced by rolling-in. A final calibration of the hollow body can be effected by a drawing process subsequent to the production by rolling-in of the predetermined breaking line.

The invention further relates to a hollow body produced according to such a method which has a constant wall thickness in the vicinity of the predetermined breaking line.

Preferably, the outer surface of the shell of such a hollow body is practically closed in the vicinity of the predetermined breaking line.

The predetermined breaking line can run spirally around the shell of such a hollow body. Furthermore, the hollow body can comprise two predetermined breaking lines shifted, with respect to each other, for example by 180°. Such a hollow body can have a small wall thickness as compared to its cross-sectional dimensions and its general outer and inner shape does not exhibit a deviation from a desired shape.

A device according to the invention for carrying out the present method is characterized in that it comprises means for producing the predetermined breaking line by rolling-in before or behind a drawing tool with a floating or fixed core.

The means for producing the breaking line preferably comprise a profile rolling wheel subjected to controllable rolling pressure as well as a depth measuring device for the breaking line produced and a closed loop control circuit comprising this measuring device for controlling the rolling pressure.

BRIEF DESCRIPTION OF THE DRAWING FIGURES

Further characteristics, objects and advantages of the invention appear from the examples of embodiment described hereafter and represented in the drawing. It is shown, in FIG. 1, a tool for producing the hollow body according to the invention, in a lateral view;

FIG. 2, a front view of the tool of FIG. 1;

FIG. 3, a partial sectional view of a hollow body according to the invention;

FIG. 4, a diagram of an extended device for producing a hollow body according to the invention;

FIG. 5, a portion of a circular cylindrical hollow body with a spirally running predetermined breaking line, FIG. 6*a*, a cross-section through a hollow body for receiving two circular cylindrical inner bodies; and FIG. 6*b*, a cross-section through a hollow body for receiving three circular cylindrical inner bodies.

DETAILED DESCRIPTION OF THE PREFERRED EMBODIMENT

Figure 1:
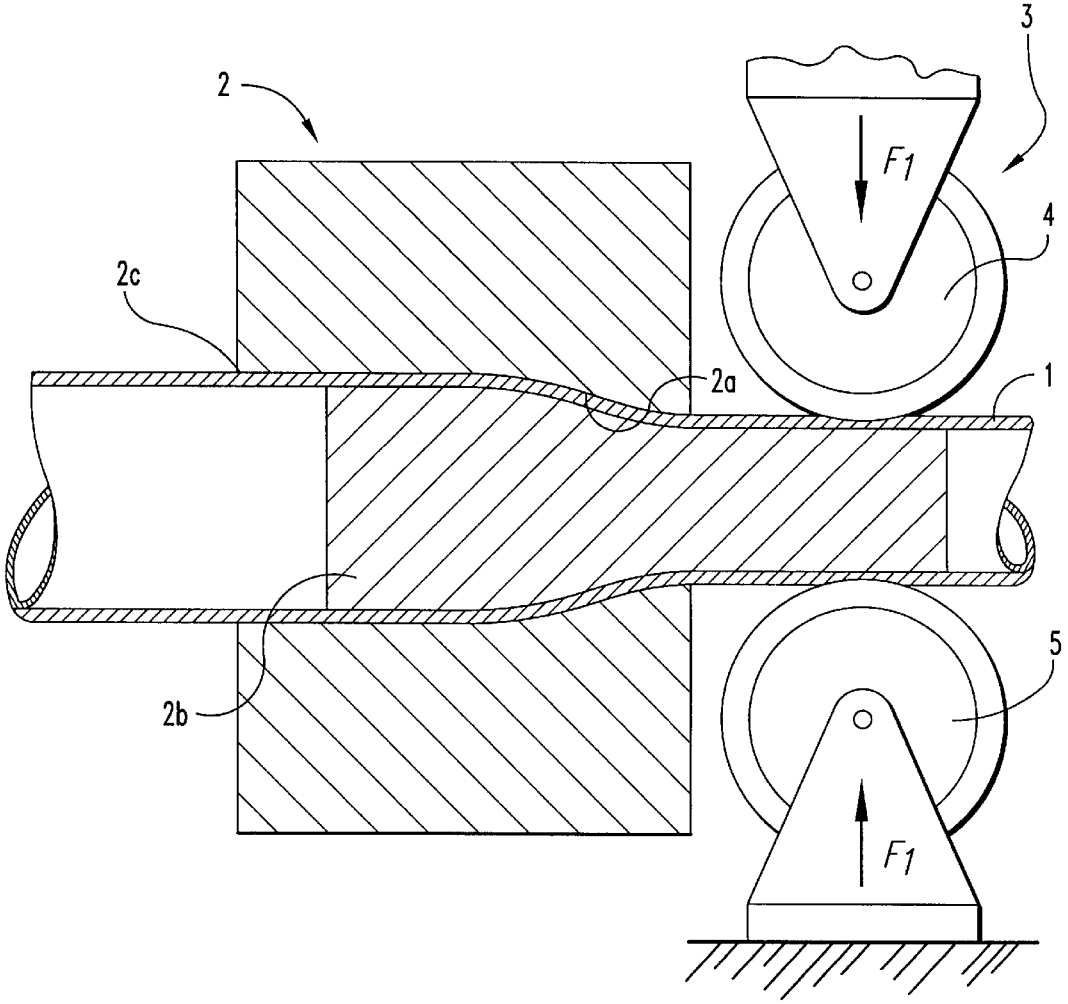

The tool shown schematically in FIG. 1 is used for producing a thin-walled circular cylindrical hollow body 1 according to the invention by means of a drawing tool 2 and a device 3 for producing the desired predetermined breaking lines by rolling. The drawing tool 2 has a drawing channel 2*a* and a free floating core 2*b*. The rolling device 3 comprises in the shown example two rolling wheels 4, 5, the profile of which is shown in the front view of FIG. 2 and which act with a force F1 on the shell of the tube 1. The free floating core 2*b* extends in longitudinal direction beyond the working position of the rolling wheels 4, 5 and therefore acts at the same time as a counter-support for these rolling wheels. The tubular body introduced in the input opening 2*c* of the drawing tool 2 is continuously moved forward and provided by the rolling wheels 4, 5 at the outlet of the drawing channel 2*a* with two diametrically opposite predetermined breaking lines, the depth of which is defined by the exerted rolling pressure. The shown arrangement makes it possible to achieve very precise dimensions of the tube and to maintain an exact rotational symmetry since the free floating core provides a counter-support for each of the rolling wheels. Due to the forces F1 acting in direction of the middle line of the tube, a displacement of material is produced in the shell of the tube and a precisely determinable remaining wall thickness results therefrom. In addition, in this way of non-chip forming of the predetermined breaking line, the region of reduced wall thickness is rendered brittle, thereby further easing the opening of the produced hollow body. The continuous manufacturing of the tube makes it possible to maintain very precise tolerances over the whole tube length and a constant resistance against the force exerted for breaking open the tubular body.

Figure 2:
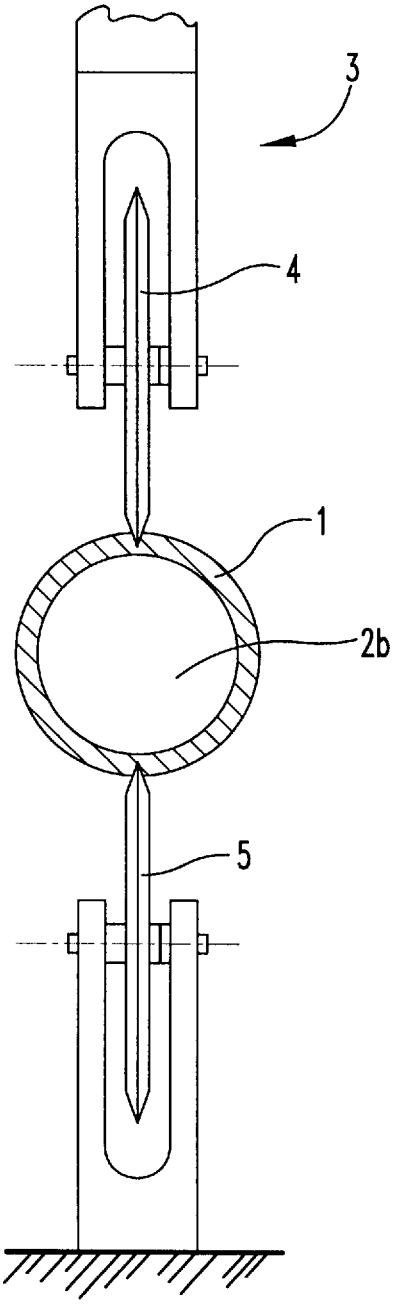

The front view of the rolling device according to FIG. 2 shows the mounting of the rolling wheels 4 and 5 and their positioning for producing predetermined breaking lines parallel to the axis. By turning the rolling wheels around the vertical, this device makes it possible to produce spiral-shaped predetermined breaking lines, the tube to be produced being, in that case, rotated around its axis in accordance with the angle. Such spiral-shaped predetermined breaking lines have the advantage, in particular in the medical technique that, after the opening of the cannula formed by the hollow body, the end breaking point is positioned at any desired angle with respect to the original position, for example at an angle of 90° and thereby the removal of the cannula can be adapted to the requirements and developments of this technique.

Due to the used method, the predetermined breaking lines of the present hollow body do not have any edges or burrs in their neighbourhood and they can in particular be produced in nearly closed form by a final calibration of the tubular body after the rolling-in of the predetermined breaking line by an appropriate choice of the diameter of the drawing channel, adjusting at the same time the desired final values of the outer and inner diameter of the hollow body.

Figure 3:
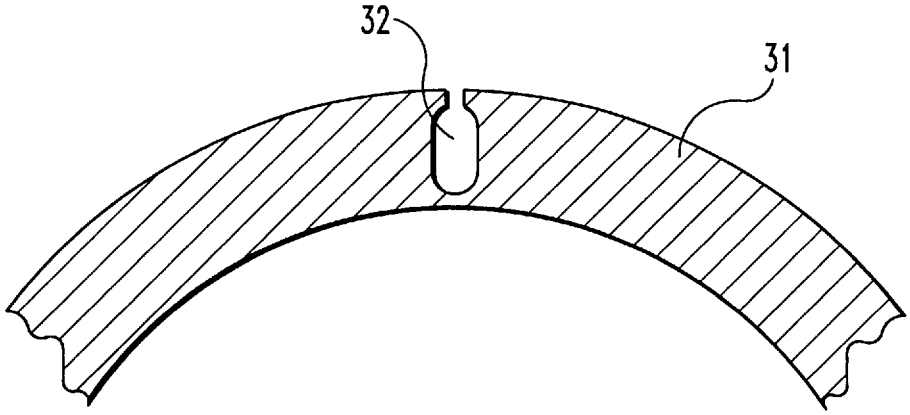

FIG. 3 shows, in cross-section through a portion of a hollow body 31, such a predetermined breaking line 32 which is practically closed on the outer shell surface of the hollow body, the tubular body having a constant outer diameter also in the vicinity of the predetermined breaking line. Such a hollow body has an increased flectional strength in spite of a reduced cross-section along the predetermined breaking line.

Figure 4:
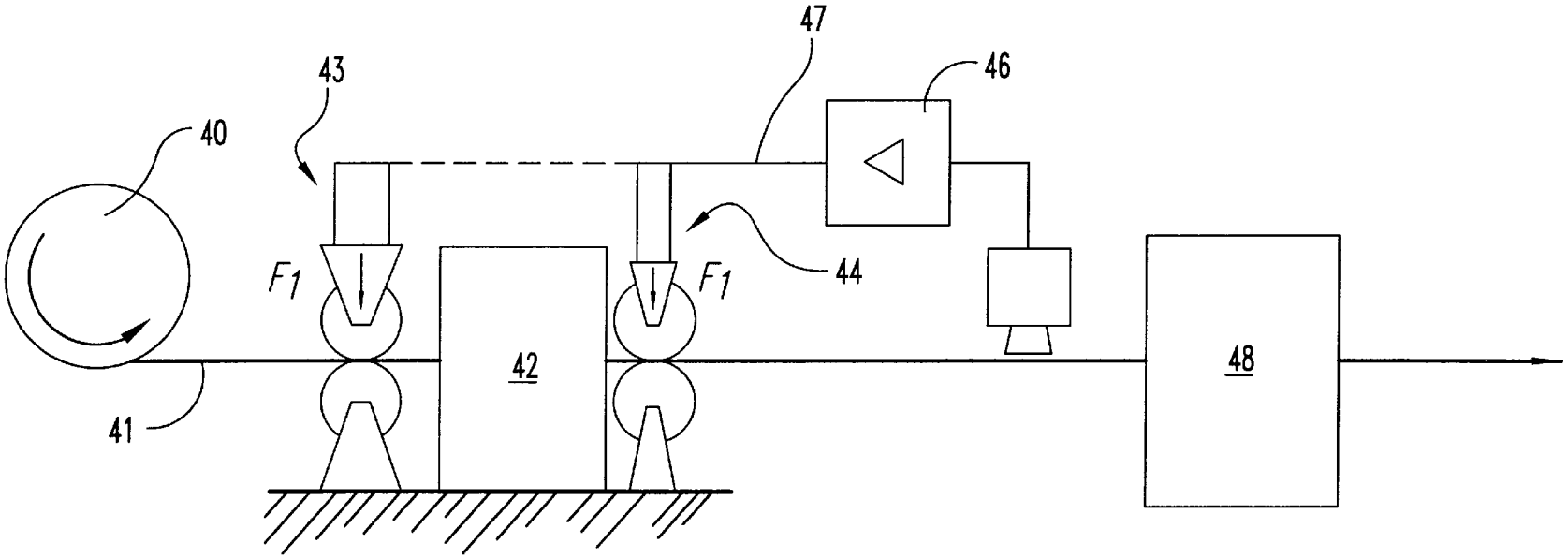

FIG. 4 shows schematically an installation for producing a hollow body with automatically controlled remaining wall thickness of the predetermined breaking lines. In this example, a hollow body 41 is being unrolled from a drum 40 and led through a drawing tool 42 of the kind described in FIG. 1. Rolling devices 43 or 44 are arranged, before or behind this drawing tool, for rolling-in the desired predetermined breaking lines. Behind the rolling device, seen in the direction of movement of the hollow body, the depth of the produced profile is measured by means of a depth measuring instrument, for example, by optical, acoustical or mechanical means. The corresponding measuring value is delivered to a control amplifier 46, at the output of which a control signal determining the rolling pressure is issued and provided to the rolling devices 43 or 44 over a line 47, as shown schematically. An arrangement 48 for cutting the continuously produced endless hollow body into desired lengths is indicated at the end of the installation. Since this is the last manufacturing step, it provides the possibility of a precise adaptation to the volume of the inner body to be packed or to be protected. It avoids thereby a capital requiring, intermediate storage of hollow bodies of same diameter and different lengths.

Figure 5:
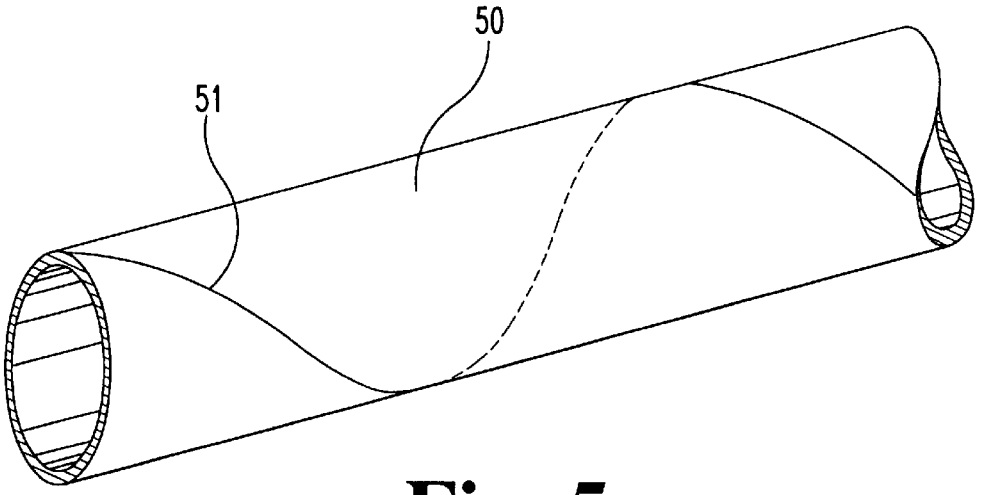

FIG. 5 shows a portion of a tubular hollow body 50 provided, as mentioned above, with a spirally running predetermined breaking line 51.

Figure 6A:
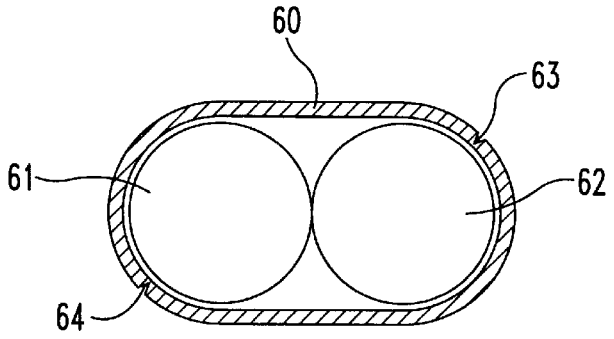
Figure 6B:
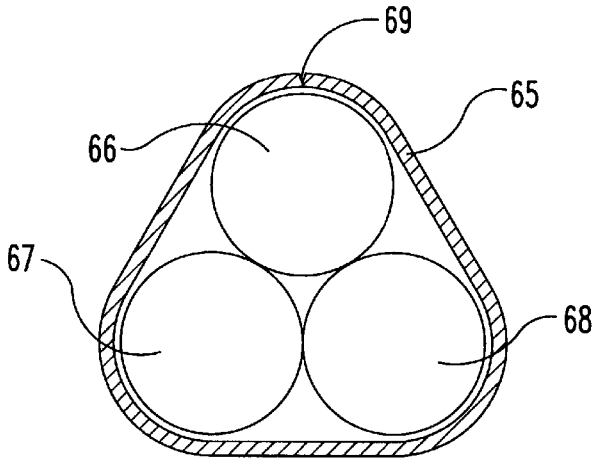

FIGS. 6*a* and 6*b* show examples of cross-sectional shapes of the produced hollow bodies 60 and 65, respectively, which are not circular cylindrical and which are in particular useful for receiving two instruments 61, 62 or three instruments 66, 67, 68, respectively, having a circular cylindrical cross-section. Generally, all cross-sectional shapes which can be produced by a drawing process can be considered, whereby predetermined breaking lines, such as 63, 64 or 69, can be produced at one or more places of the shell periphery. However, a cross-section of rotational-symmetric shape makes it possible to completely use the inner volume of the hollow body for objects of circular cylindrical cross-section.

The method according to the invention provides the possibility of producing, in particular, hollow bodies of different final diameters, independently from the outer diameter and the wall thickness of the initial material, in a continuous working process. The production as a whole is substantially simplified and guarantees an increased operational safety, in particular in the case of a continuous watching of the remaining wall thickness. This also provides an increased and constant quality of the final product which is of great importance, in particular in medical manipulation, since in this case, a constant splitting force is essential for the safety of use.

I claim:

1. A method of producing a metallic hollow body having a cylindrical shell which is provided on its outer surface with at least one predetermined breaking line, said method comprising the step of drawing said hollow body in a drawing channel having a floating or fixed core and the step of continuously rolling-in said predetermined breaking line on the outer side of said shell before or behind said drawing channel, said floating or fixed core extending up to the position where said rolling-in is effected.

2. A method according to claim 1, wherein said breaking line is produced by means of at least one profile rolling wheel subjected to controllable rolling pressure and wherein the depth of said breaking line is being measured and said rolling pressure is being controlled through a closed-loop control circuit as a function of the measured depth.

3. A method of producing a metallic hollow body having a cylindrical shell which is provided on its outer surface with at least one predetermined breaking line, said shell being formed by a drawing process and said predetermined breaking line being produced continuously by rolling-in on the outer shell, said method comprising the steps of effecting a final calibration of the hollow body by a drawing process subsequent to the production by rolling-in of said predetermined breaking line.

* * * * *